US007789366B2

(12) United States Patent
McDonald

(10) Patent No.: US 7,789,366 B2
(45) Date of Patent: Sep. 7, 2010

(54) EYEWEAR HOLDER

(76) Inventor: Rodney McDonald, 419 W. Mission St., Lot 9, P.O. Box 352, Strawberry Point, IA (US) 52076

( * ) Notice: Subject to any disclaimer, the term of this patent is extended or adjusted under 35 U.S.C. 154(b) by 192 days.

(21) Appl. No.: 11/195,172

(22) Filed: Aug. 2, 2005

(65) Prior Publication Data

US 2006/0053594 A1 Mar. 16, 2006

Related U.S. Application Data

(60) Provisional application No. 60/598,131, filed on Aug. 2, 2004.

(51) Int. Cl.
*A47G 1/10* (2006.01)

(52) U.S. Cl. ..... 248/316.4; 248/314; 248/902

(58) Field of Classification Search ..... 248/902, 248/314, 316.1, 316.4, 316.7, 316.8, 74.2, 248/230.3
See application file for complete search history.

(56) References Cited

U.S. PATENT DOCUMENTS 4,118,838 A * 10/1978 Schiefer et al. ..... 24/115 R
4,128,224 A * 12/1978 Guichard ..... 248/316.4
4,202,087 A * 5/1980 Wilderman ..... 166/243
4,480,808 A * 11/1984 Reimer ..... 248/73
5,178,283 A * 1/1993 Ennis ..... 211/4
5,372,345 A * 12/1994 Schmidt ..... 248/229.16
5,711,397 A * 1/1998 Flora et al. ..... 182/3
6,126,122 A * 10/2000 Ismert ..... 248/74.1
6,210,003 B1 * 4/2001 Chan ..... 351/112
6,446,915 B1 * 9/2002 Ismert ..... 248/68.1
2004/0200790 A1 * 10/2004 Zoueki ..... 211/85.1

* cited by examiner

*Primary Examiner*—Amy J Sterling
(74) *Attorney, Agent, or Firm*—Kent A. Herink; Emily E. Harris

(57) ABSTRACT

There is disclosed a holder for eyewear which supports the eyewear for quick, easy, one-handed access by a user. A first jaw member is mounted on a base and a second jaw member is positioned a distance away from the first jaw member. A pair of glasses is inserted between the jaw members and adjusted to be releasably retained between the jaw members. Preferably, one of the jaw members is adjustable to permit a user to change the separation of the jaw members so as to accommodate a large variation of sizes of eyewear.

5 Claims, 2 Drawing Sheets

EYEWEAR HOLDER

This application claims priority to U.S. patent application Ser. No. 60/598,131, filed Aug. 2, 2004.

BACKGROUND OF THE INVENTION

The invention relates generally to a holder for eyewear and, more specifically, to a support for eyewear, particularly safety glasses, that is mounted on a vertical or horizontal surface and supports the eyewear in a convenient and easily accessible position for use by a wearer of the eyewear.

Many people use eye glasses on a non-continuous basis. For example, people who are working in a shop or other work environment may have specific, localized tasks which require them to wear safety glasses, but otherwise do not need to wear them on a continuous basis. Others may have reading glasses which they need only while reading. A common problem is that infrequent or non-continual wearers of glasses will frequently misplace their glasses so they will not be available when they are needed. For someone who needs reading glasses, this may only be an inconvenience. For those who need safety glasses, however, the problem is that they are likely proceed with the task where the safety glasses are needed without seeking out the misplaced pair and thereby risk eye injury. The problem could be solved by an inexpensive and convenient holder of the eyewear that is positioned near the area where the need for the glasses frequently exists so that the infrequent or non-continuous wearer would have quick and easy access to a pair when needed. An example of an application of the present invention is in a private workshop that contains a power tool, such as a grinder or the like. The eyewear support is mounted near the grinder so that the user of the grinder can reach for the glasses held on the support and, with one hand, remove the glasses from the support or holder and put them on while standing in position to use the grinder.

SUMMARY OF THE INVENTION

The invention consists of a holder for glasses or eyewear that accepts and supports a large variety of glasses and holds them for easy, one-handed access by a user. A first jaw member secured to a base and a second jaw member is mounted a spaced-apart distance from the first jaw member. The jaws are sized to permit a portion of the glasses to be inserted between them and positioned so that the jaws releasably hold the glasses. The base is adapted for mounting in a location which positions the glasses for easy access by a user. A particular application of the holder is to be positioned near work stations, such as saws, grinders, and other power equipment, where safety glasses are to be worn so that a pair of safety glasses is always readily accessible to a user who intends to use the equipment at the work station.

In a preferred embodiment, one of the jaws is adjustable relative to the other to allow a user to adjust the spacing between the jaws to allow the holder to be used with a wider range of glasses.

DETAILED DESCRIPTION OF A PREFERRED EMBODIMENT

Figure 1:
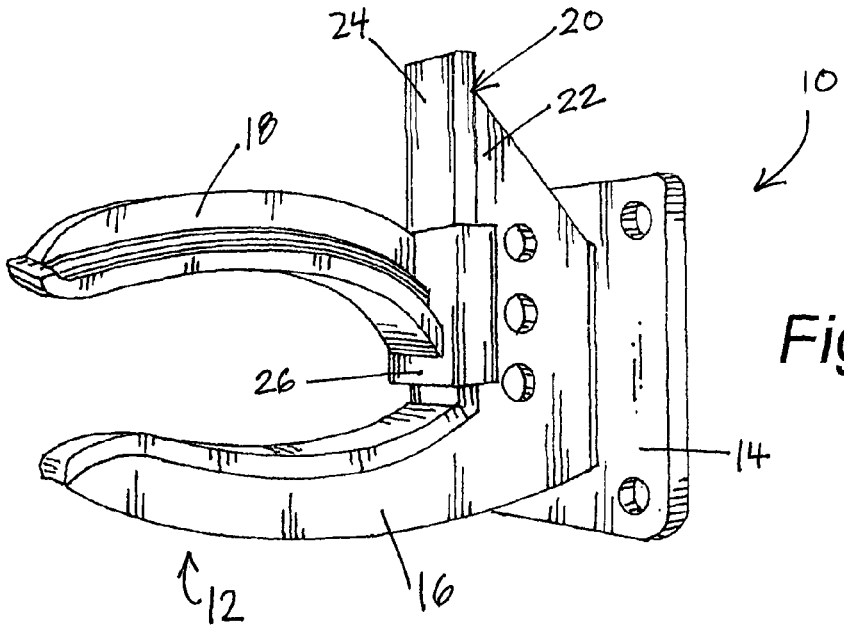
FIG. 1 is a perspective view of the eyewear holder of the present invention.
Figure 2:
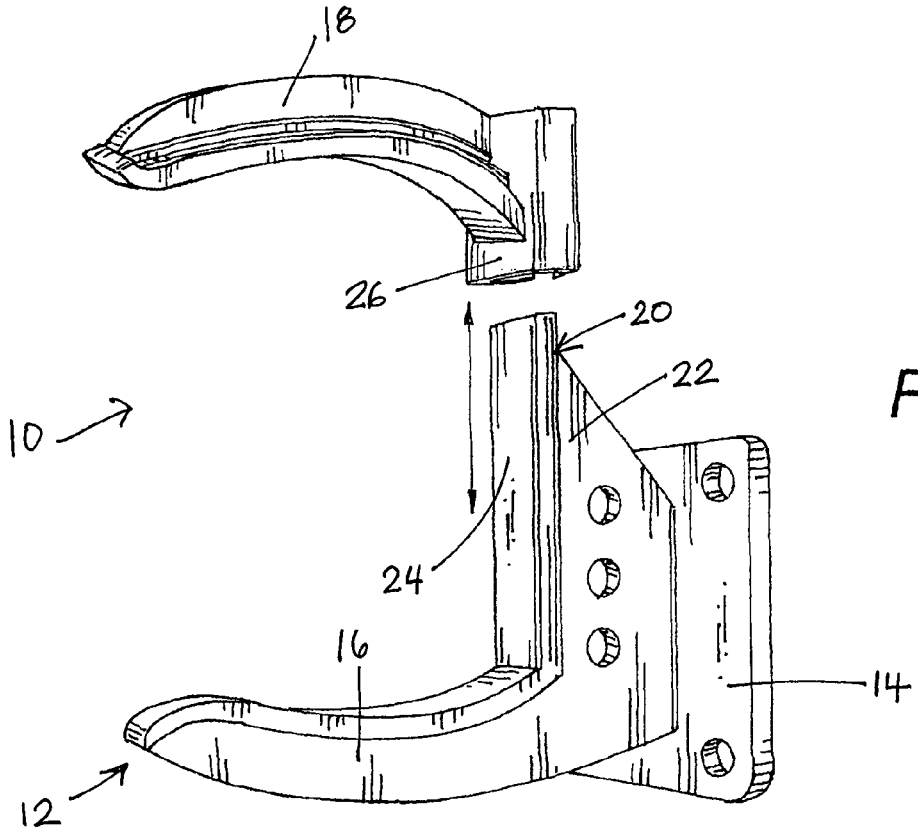
FIG. 2 is an exploded perspective view of the eyewear holder of FIG. 1.

As illustrated in FIGS. 1 and 2, generally at 10, the invention consist of an eyewear holder for eye glasses including a generally U-shaped frontpiece 12 that is affixed to a base 14. The U-shaped frontpiece includes a lower, fixed jaw member 16 and an upper, adjustable jaw member 18. The fixed jaw member 16 has a rail section 20 of a generally T-shape in cross-section, including a support section 22 and a transverse rail section 24. The adjustable jaw member 18 is provided with a corresponding C-shaped section 26. The rail section 20 of the fixed jaw is inserted inside the C-shaped section 26 of the adjustable jaw member 18 in a close-fit, sliding relation to permit adjustment of the spacing of the adjustable jaw member 18 relative to the fixed jaw member 16. While the preferred embodiment permits adjustment between the the jaw members, an embodiment in which both jaw members are fixed is also within the scope of the present invention.

Figure 3:
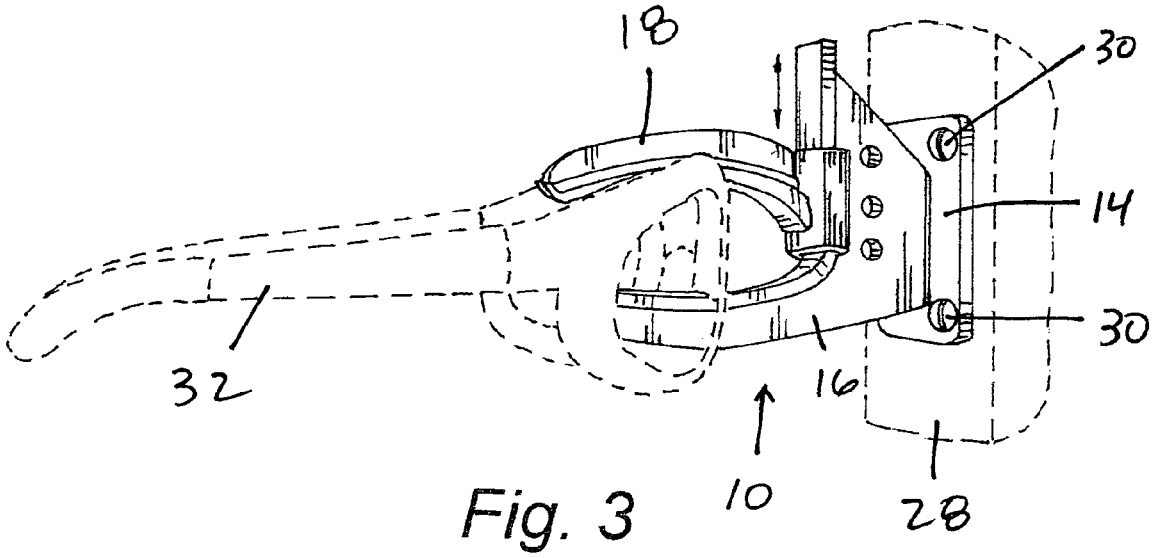
FIG. 3 is perspective view corresponding to FIG. 1 wherein the eyewear holder has been mounted on a vertical support and is shown holding a pair of glasses.

As illustrated in FIG. 3, the eyewear holder 10 is preferably mounted on a vertical support 28, by screws 30, or the like. In this mounting position, the holder 10 is used to support a pair of glasses 32 in a horizontal position essentially identical to the position when being worn by a user, with the fixed jaw member 16 under the nose piece of the classes 32 and the adjustable jaw member 18 above the nose piece so that the glasses 32 are held between the two jaw members. The jaw members 16 and 20 preferably are made of a resilient material to allow for easy insertion and removal of the glasses 32 between them while resiliently retaining the glasses 32 therebetween when inserted. Ridges and bumps may be formed in the jaws members 16 and 18 to assist in accommodating glasses 32 of different sizes and to assist in retaining the glasses 32 in the mounted position. An insert may be used to reduce the opening between the jaws for glasses of particularly small dimensions.

Most typically, it is envisioned that a user will tilt the glasses 32 away from their horizontal orientation when inserting the glasses between the jaw members 16 and 18 so as to reduce the cross-section presented to the opening between the jaw members 16 and 18. On insertion, the user will then pivot the glasses 32 toward the horizontal so as to engage the jaw members 16 and 18 to releasably hold the glasses 32 in place therebetween. On removal of the glasses 32, the reverse procedure is followed. Preferably, the jaw members 16 and 18 present a curved profile open toward each other so that the space between them varies from the opening toward the base 14, facilitating the holding of a larger variety of glasses 32.

The mounting on a vertical support allows single-hand use, less wear on the eyewear, can be mounted at eye level and reduces exposure and damage for dust and other particles. Of course, the base could be fixed to the bottom of the fixed jaw member 16 at a right angle to the illustrated orientation, and then the holder 10 could be mounted on a horizontal surface and yet support the glasses 32 in the same orientation.

The holder 10 can be mounted at any location where a person is likely to need glasses, for example, adjacent a grinder, drill, saw or other power tool. The holder 10 may either be permanently mounted or may have a magnetic mounting that would allow it to be moved from place to place, or placed on any metal surface, such as a tool box. The eye glasses 32 preferably are supported in the horizontal position with the bows or earpieces extended, open and ready to wear.

A particular application of the invention would be in ambulances and other emergency or EMT vehicles. Multiple holders could be used at a single location, for example at the entry to a plant where tours are conducted.

Because the adjustable jaw member 18 is mounted for sliding adjustment toward and away from the fixed jaw member 18, the holder 10 can accommodate an even wider variety in sizes of the glasses 32. Operation is simple and can be done with one hand. Because of its versatility, the adjustable embodiment may find wide use, for example at desks, computers, in the kitchen or laundry for reading glasses, or even by the pool for sunglasses.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art that have the disclosure before them will be able to make modifications and variations therein without departing from the scope of the invention.

I claim:

1. A holder for eyewear to be fastened on a supporting surface, comprising:

(a) a base having openings for the insertion of one or more fasteners;

(b) a fixed jaw member mounted on the base and comprising a first slide section comprising a transverse rail extended generally along the base and a jaw member extended generally away from the base;

(c) a moveable jaw comprising a jaw member and a C-shaped second slide section defining a transverse opening for said transverse rail; and (d) a close-fit between said transverse rail of the first slide section of the fixed jaw and the C-shaped second slide section of the moveable jaw for sliding movement of the moveable jaw toward and away from the fixed jaw member and longitudinally to the base, to a plurality of fixed positions for use with a portion of the eyewear which is received between the jaw members and releasably supported by the holder.

2. The holder as defined in claim 1, wherein at least one of the jaw members comprises a resilient material.

3. The holder as defined in claim 1, wherein the portion of the eyewear is the nose section between the lenses.

4. The holder as defined in claim 1, wherein at least one of the jaw members has a curved profile so that the spacing between the jaw members varies across the jaw members.

5. The holder as defined in claim 2, wherein the resilient jaw member deflects upon insertion or removal of the eyewear between the jaw members while the close-fit between the slide sections prevents displacement of the moveable jaw relative to the fixed jaw member along the first slide section.

* * * * *